US008574018B1

(12) United States Patent
Shiffler et al.

(10) Patent No.: US 8,574,018 B1
(45) Date of Patent: Nov. 5, 2013

(54) TUBULAR CONNECTION MEMBER WITH STAMPED THREADS ON ITS EXTERIOR

(75) Inventors: James Charles Shiffler, Hummelstown, PA (US); Paul Eric Wittensoldner, Washington Boro, PA (US); Leo Joseph Graham, Hershey, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 27 days.

(21) Appl. No.: 13/444,425

(22) Filed: Apr. 11, 2012

(51) Int. Cl.
*H01R 13/46* (2006.01)

(52) U.S. Cl.
USPC ..... 439/892

(58) Field of Classification Search
USPC ..... 439/892–894
See application file for complete search history.

(56) References Cited

U.S. PATENT DOCUMENTS

| | | | | |
|---|---|---|---|---|
| 4,860,570 | A | 8/1989 | Perrault et al. | |
| 6,077,132 | A * | 6/2000 | Gligorijevic | 439/891 |
| 2012/0315808 | A1 * | 12/2012 | Millard | 439/892 |

* cited by examiner

*Primary Examiner* — Chandrika Prasad

(57) ABSTRACT

A connection member includes a tube extending a length along a central longitudinal axis. The tube includes a central passageway that extends through the length of the tube. The tube has a non-circular cross-sectional shape along the length of the tube. The tube includes an exterior side that defines a perimeter of the non-circular cross-sectional shape of the tube. Stamped threads are formed on the exterior side of the tube along at least a portion of the length of the tube. The stamped threads are discontinuous along the perimeter of the non-circular cross-sectional shape of the tube such that the stamped threads only extend along at least one portion of the perimeter of the non-circular cross-sectional shape of the tube.

20 Claims, 8 Drawing Sheets

TUBULAR CONNECTION MEMBER WITH STAMPED THREADS ON ITS EXTERIOR

BACKGROUND OF THE INVENTION

The subject matter herein relates generally to connection members having threads for threadably connecting to other connection members.

Some known complementary electrical connectors are configured to be threadably connected together to hold the connectors together in a mated condition. Specifically, electrical connectors may include connection members that include threads that threadably engage each other to form the threaded connection between the complementary electrical connectors. The connection members are sometimes electrical contacts such that engagement between the connection members establishes an electrical connection between the complementary electrical connectors. For example, the connection members may define radially outer electrical contacts of coaxial connectors.

At least some known electrical connectors that include threaded connection members are fabricated using a screw machine process or a die casting process. For example, the threaded connection members of at least some known electrical connectors are fabricated using a screw machining or die casting process. But, screw machining and/or die casting processes may be relatively costly. Die casting and/or screw machining processes may also be relatively time consuming, which may limit the number of electrical connectors and/or threaded connection members that can be fabricated within a given amount of time. Moreover, a relatively large amount of scrap material may be generated using a screw machine process, which may increase a cost of fabricating an electrical connector and/or a threaded connection member.

A need remains for a threaded connection member of an electrical connector that is less costly to fabricate.

BRIEF DESCRIPTION OF THE INVENTION

In one embodiment, a connection member includes a tube extending a length along a central longitudinal axis. The tube includes a central passageway that extends through the length of the tube. The tube has a non-circular cross-sectional shape along the length of the tube. The tube includes an exterior side that defines a perimeter of the non-circular cross-sectional shape of the tube. Stamped threads are formed on the exterior side of the tube along at least a portion of the length of the tube. The stamped threads are discontinuous along the perimeter of the non-circular cross-sectional shape of the tube such that the stamped threads only extend along at least one portion of the perimeter of the non-circular cross-sectional shape of the tube.

In another embodiment, an electrical connector is provided for mating with a mating connector. The electrical connector includes an electrical contact having a mating interface. The electrical contact is configured to mate with a mating contact of the mating connector at the mating interface. The electrical connector also includes a housing holding the electrical contact. The housing includes a connection member that is configured to be threadably connected to the mating connector. The connection member includes a tube extending a length along a central longitudinal axis. The tube includes a central passageway that extends through the length of the tube. The tube has a non-circular cross-sectional shape along the length of the tube. The tube includes an exterior side that defines a perimeter of the non-circular cross-sectional shape of the tube. Stamped threads are formed on the exterior side of the tube along at least a portion of the length of the tube. The stamped threads are discontinuous along the perimeter of the non-circular cross-sectional shape of the tube such that the stamped threads only extend along at least one portion of the perimeter of the non-circular cross-sectional shape of the tube.

In another embodiment, a connection member includes a tube extending a length along a central longitudinal axis. The tube extends a width and a height along respective width and height axes that extend approximately perpendicular to the central longitudinal axis and each other. The tube includes an exterior side. Stamped threads are formed on the exterior side of the tube along at least a portion of the length of the tube. The stamped threads have a minor diameter that is greater than at least one of the width and the height of the tube.

DETAILED DESCRIPTION OF THE INVENTION

Figure 1:
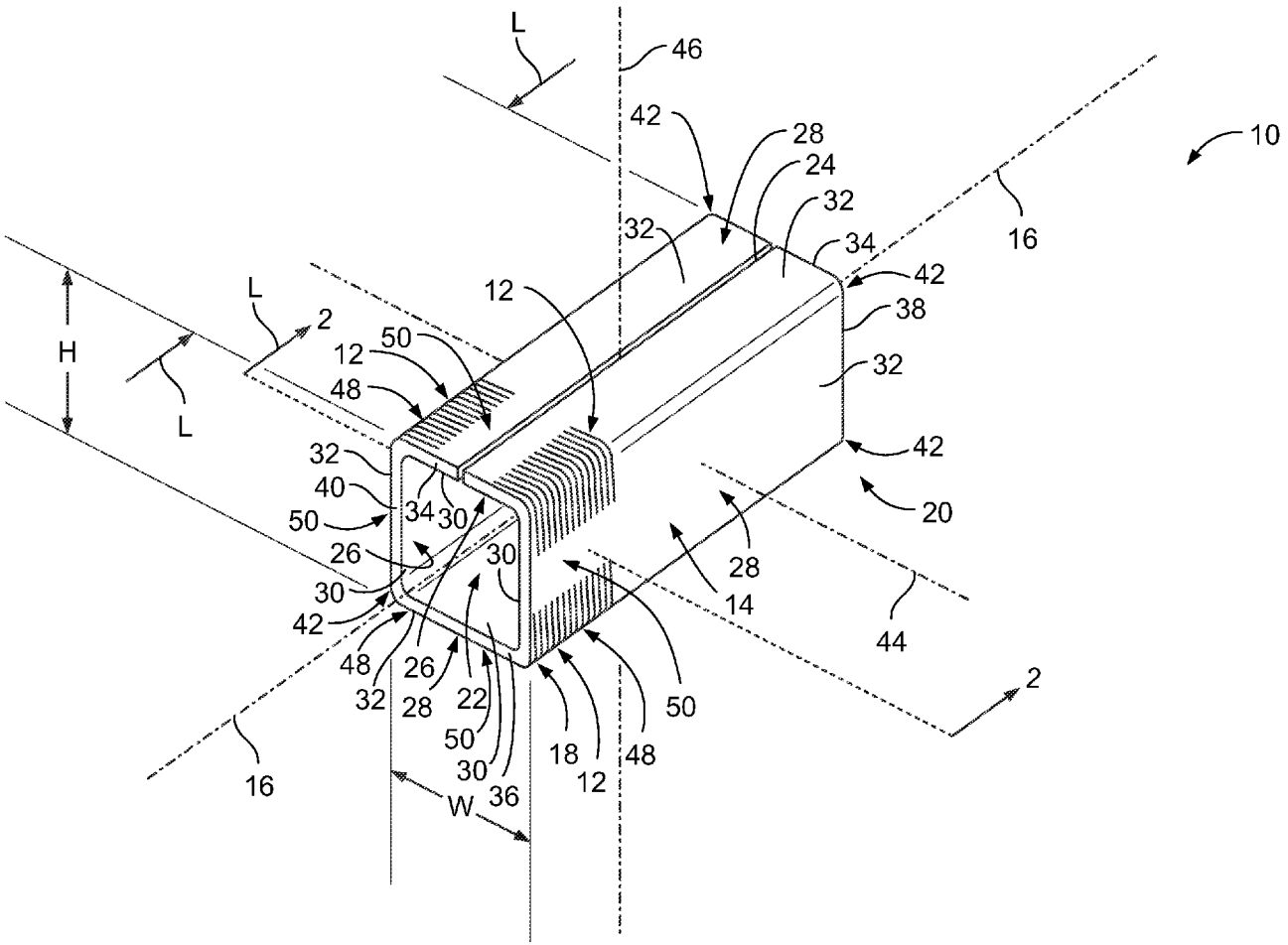
FIG. 1 is a perspective view of an exemplary embodiment of a connection member.

FIG. 1 is a perspective view of an exemplary embodiment of a connection member 10. The connection member 10 may be used to form a threadable connection to a complementary connection member (not shown). In other words, the connection member 10 includes stamped threads 12 that enable the connection member 10 to be threadably connected to complementary threads (not shown) of the complementary connection member. In some embodiments, the connection member 10 is a component of an electrical connector (e.g., the electrical connector 300 shown in FIG. 9). Moreover, in some embodiments, the connection member 10 is an electrical contact (e.g., the embodiment illustrated in FIG. 9), whether or not the connection member is a component of an electrical connector. For example, the connection member 10 may be at least partially electrically conductive and engagement between the connection member 10 and the complementary connection member may establish an electrical connection therebetween. The connection member 10, however, is not limited to being used as an electrical contact and/or as a component of an electrical connector. Rather, the connection member 10 may be any type of component (used in any larger assembly, system, application, and/or the like) that is configured to be threadably connected to a complementary connection member. Examples of uses of the connection member 10 include, but are not limited to, a shell of an electrical and/or mechanical connector, an electrical contact, an electrical contact of an electrical connector, a shield of an electrical connector, mounting hardware, a ground contact of a bezel, a component of a circuit board, and/or the like. The connection member 10 may be referred to herein as an "electrical contact".

The connection member 10 includes a tube 14 that extends a length L along a central longitudinal axis 16. The tube 14 extends the length L from an end 18 to an opposite end 20. The tube 14 includes a central passageway 22 that extends along the central longitudinal axis 16 and through the length L of the tube 14. In the exemplary embodiment, the central passageway 22 extends through an entirety of the length L of the tube 14. But, in other embodiments, the central passageway 22 may extend through only a portion of the length L of the tube 14. Optionally, the tube 14 includes a seam 24 that extends along at least a portion of the length L of the tube 14.

The tube 14 includes an interior side 26 and an opposite exterior side 28. The interior side 26 includes an interior surface 30 of the tube 14 that defines the boundary of the central passageway 22. The exterior side 28 includes an exterior surface 32 that faces radially (relative to the central longitudinal axis 16) opposite the interior surface 30.

Along the length L, the tube 14 has a non-circular cross-sectional shape taken along a plane that extends approximately perpendicular to the central longitudinal axis 16. In the exemplary embodiment, the tube 14 has a rectangular cross-sectional shape, along the length L of the tube 14, that is taken along a plane that extends approximately perpendicular to the central longitudinal axis 16. Specifically, along the length L, the tube 14 has a square cross-sectional shape taken along a plane that extends approximately perpendicular to the central longitudinal axis 16. But, the tube 14 may have any non-circular cross-sectional shape, along the length L, that is taken along a plane that extends approximately perpendicular to the central longitudinal axis 16, such as, but not limited to, an oval cross-sectional shape, a rectangular cross-sectional shape that is not square, and/or the like.

Figure 2:
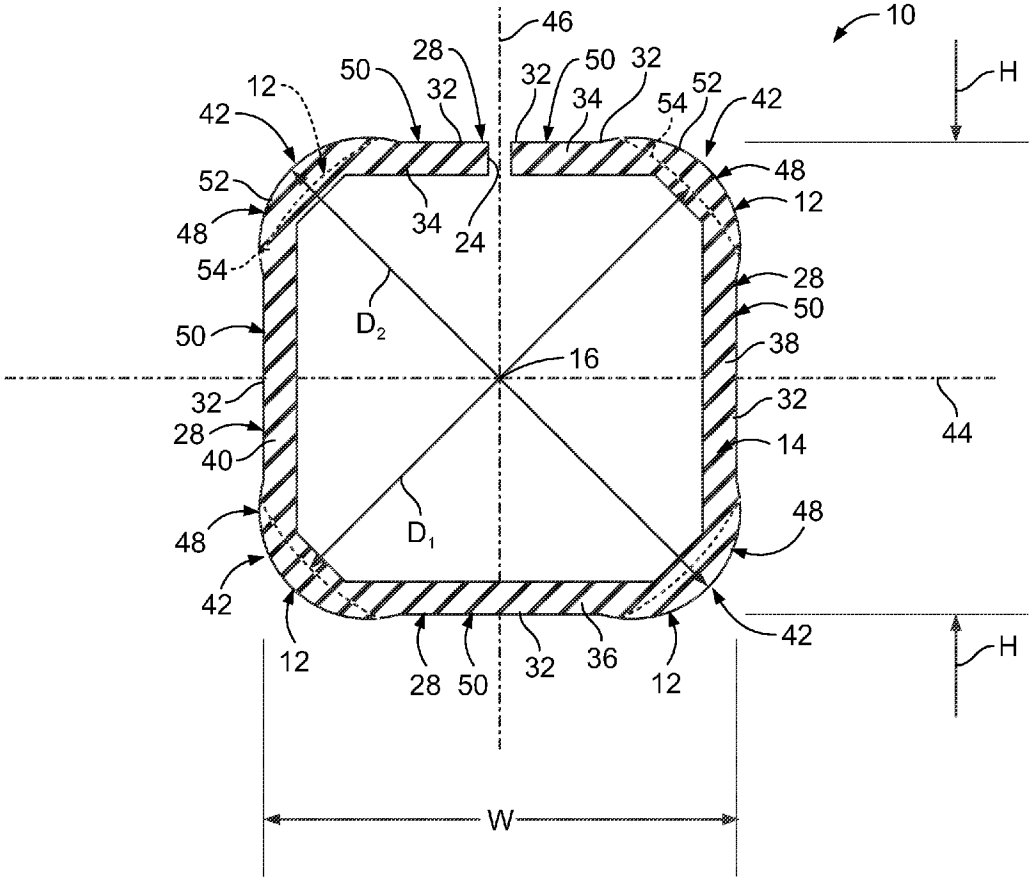
FIG. 2 is a cross-sectional view of the connection member shown in FIG. 1 taken along line 2-2 of FIG. 1.

FIG. 2 is a cross-sectional view of the connection member 10 taken along line 2-2 of FIG. 1. As should be apparent from FIG. 1, the line 2-2 is aligned within a plane that extends approximately perpendicular to the central longitudinal axis 16 such that the cross section of FIG. 2 is taken along a plane that extends approximately perpendicular to the central longitudinal axis 16. Referring now to FIGS. 1 and 2, the rectangular cross-sectional shape of the tube 14 is defined by an upper wall 34, a lower wall 36, and opposing side walls 38 and 40 of the tube 14. The side walls 38 and 40 intersect the upper wall 34 and the lower wall 36 at corners 42. The tube 14 may include any number of walls that define any non-circular cross-sectional shape.

The exterior side 28 of the tube 14 defines a perimeter of the non-circular cross-sectional shape of the tube 14. Specifically, the exterior surface 32 of the exterior side 28 defines the perimeter of the non-circular cross-sectional shape of the tube 14. The tube 14 extends a width W defined from the exterior surface 32 at the side wall 38 to the exterior surface 32 at the side wall 40. The tube 14 extends a height H from the exterior surface 32 at the upper wall 34 to the exterior surface 32 at the lower wall 36. The tube 14 extends the width W and the height H along respective width and height axes 44 and 46. As should be apparent in FIGS. 1 and 2, axes 44 and 46 each extend approximately perpendicular to the central longitudinal axis 16. The width and height axes 44 and 46, respectively, extend approximately perpendicular to each other.

As briefly described above, the connection member 10 includes the stamped threads 12, which enable the connection member 10 to be threadably connected to the complementary connection member (not shown). The stamped threads 12 are referred to as "stamped threads" because the stamped threads 12 are formed using a stamping process, as will be described in more detail below. The stamped threads 12 are formed on the exterior side 28, and specifically into the exterior surface 32, of the tube 14 along at least a portion of the length L of the tube 14. In the exemplary embodiment, the stamped threads 12 are formed on the exterior side 28 at the end 18 of the tube 14 and along a portion of the length L of the tube 14 that extends from the end 18. But, the stamped threads 12 may be formed at any location(s) along the length L of the tube 14. For example, in addition or alternatively to being formed at the end 18, the stamped threads 12 may be formed on the exterior side 28 at the end 20 of the tube 14. In some alternative embodiments, the stamped threads 12 are formed on the exterior side 28 along an entirety of the length L of the tube 12. Moreover, in some alternative embodiments, the stamped threads 12 are formed on the exterior side 28 along two or more distinct segments of the length L of the tube 14.

The stamped threads 12 are discontinuous along the perimeter of the non-circular cross-sectional shape of the tube 14. Accordingly, the stamped threads 12 only extend along at least one portion of the perimeter of the non-circular cross-sectional shape of the tube 14. In other words, along the perimeter of the cross-sectional shape of the tube 14, the stamped threads 12 are only formed on the exterior side 28 of the tube 14 at one or more partial segments of the perimeter. When the stamped threads 12 are formed on the exterior side 28 at more than one partial segment of the perimeter, the plurality of partial segments of the perimeter are spaced-apart from each other along the perimeter.

In the exemplary embodiment, the at least one portion of the perimeter along which the stamped threads 12 are formed includes the corners 42 of the tube 14. The stamped threads 12 are formed, in the exemplary embodiment, on the exterior side 28 of the tube 14 at four partial segments 48 of the perimeter of the non-circular cross-sectional shape of the tube 14. The four partial segments 48 of the perimeter along which the stamped threads 12 are formed include the corners 42, as should be apparent from FIGS. 1 and 2. The stamped threads 12 are thus, in the exemplary embodiment, formed on the exterior side 28 of the tube 14 along the corners 42 of the tube 14. As also shown in FIGS. 1 and 2, the four partial segments 48 of the perimeter along which the stamped threads 12 are formed are spaced-apart from each other along the perimeter. The upper wall 34, the lower wall 36, and the side walls 38 and 40 of the tube 14 include segments 50 that are aligned along the length L of the tube 14, and thus along the central longitudinal axis 16, with the stamped threads 12. The segments 50 are devoid of the stamped threads 12. In other words, the segments 50 do not include the stamped threads 12. In the exemplary embodiment, the segments 50 define flats of the walls 34, 36, 38, and 40 that extend along the perimeter between adjacent partial segments 48 of the perimeter. Adjacent partial segments 48 of the perimeter of the non-circular cross-sectional shape of the tube 14 may be referred to herein as "adjacent segments of the stamped threads".

Although four are shown, the stamped threads 12 may be formed along any number of the partial segments 48 of the perimeter. Moreover, each partial segment 48 of the perimeter along which stamped threads 12 are formed may include any location along the perimeter of the non-circular cross-sectional shape of the tube 14. In other words, the stamped threads 12 are not limited to being formed on the exterior side 28 of the tube 14 along the corners 42, but rather may be additionally or alternatively formed at one or more other locations along the perimeter. In some alternative embodiments, the stamped threads 12 are formed along only some of the corners 42 of the tube 12. For example, in alternative embodiments wherein the tube 14 has a non-square rectangular cross-sectional shape, if a circular die (e.g., the circular die 200 shown in FIGS. 5-8) is used to form the stamped threads 12 then the stamped threads 12 may be formed along only two of the corners 42 of the tube 14.

Referring now solely to FIG. 2, the stamped threads 12 include peaks 52 and troughs 54. A minor diameter $D_1$ of the stamped threads 12 is defined at the troughs 54 of the stamped threads 12. A major diameter $D_2$ of the stamped threads 12 is defined at the peaks 52 of the stamped threads 12. As can be seen in FIG. 2, the minor diameter $D_1$ of the stamped threads 12 is greater than both the width W and height H of the tube 14. Similarly, the major diameter $D_2$ of the stamped threads 12 is greater than both the width W and the height H of the tube 14. The stamped threads 12 may be fine threads or coarse threads. The stamped threads 12 may have any size.

The peaks 52 of the stamped threads 12 may increase the outer dimension of the exterior surface 32 of the exterior side 28 of the tube 14 as the stamped threads 12 are formed into the exterior surface 32. In other words, forming of the stamped threads 12 on the exterior side 28 may cause a radially (relative to the central longitudinal axis 16) outward extrusion of portions of the exterior surface 32 that form the peaks 52. In such embodiments, the width W of the tube 14 is defined from the exterior surface 32 at the segment 50 of the side wall 38 to the exterior surface 32 at the segment 50 of the side wall 40, and the height H of the tube 14 is defined from the exterior surface 32 at the segment 50 of the upper wall 34 to the exterior surface 32 at the segment 50 of the lower wall 36.

The tube 14 may be fabricated from any material(s). In some embodiments, the tube 14 is fabricated from any material(s) that enable the tube 14 to be electrically conductive. The tube 14 may be fabricated using any method, process, structure, means, and/or the like, such as, but not limited to, using a cutting process, using a casting process, using a die-casting process, using a molding process, using a forming process, and/or the like. Cutting processes include, but are not limited to, water cutting, stamping, laser cutting, blanking, punching, cutting using a saw, drill bit, plane, mill, and/or other solid cutting tool, and/or the like. Forming processes include, but are not limited to, drawing, bending, stamping, and/or the like. When the tube 14 is fabricated using a cutting process, the tube 14 may be cut from a reel of material, from a blank of material, from an approximately flat sheet of material, from an approximately flat material, from a rod of material, from a length of tubing, and/or the like.

In some embodiments, the tube 14 is a cut and formed tube that is cut from a material and then formed to include the shape of the tube 14. In some other embodiments, the tube 14 is cut from a length of tubing that has the rectangular cross-sectional shape of the tube 14. An example of a cut and formed tube includes cutting a rectangular blank out of an approximately flat sheet of material. Once the material has been cut, the material may be formed to define the finished shape of the tube 14. For example, the rectangular blank may be bent at the corners 42 to define the walls 34, 36, 38, and 40 and the rectangular cross-sectional shape of the tube 14. When cut and formed in such a manner, the finished shape of the tube 14 may include the seam 24. In some embodiments, the tube 14 is a stamped and formed tube that is stamped from a material and then formed to include the finished shape of the tube 14. Moreover, in some embodiments, the tube 14 is a cut and drawn tube that is cut from a material and drawn around a mandrel (not shown) to form the finished shape of the tube 14. Cut and formed connection members may be less expensive to fabricate than machined connection members.

Figure 3:
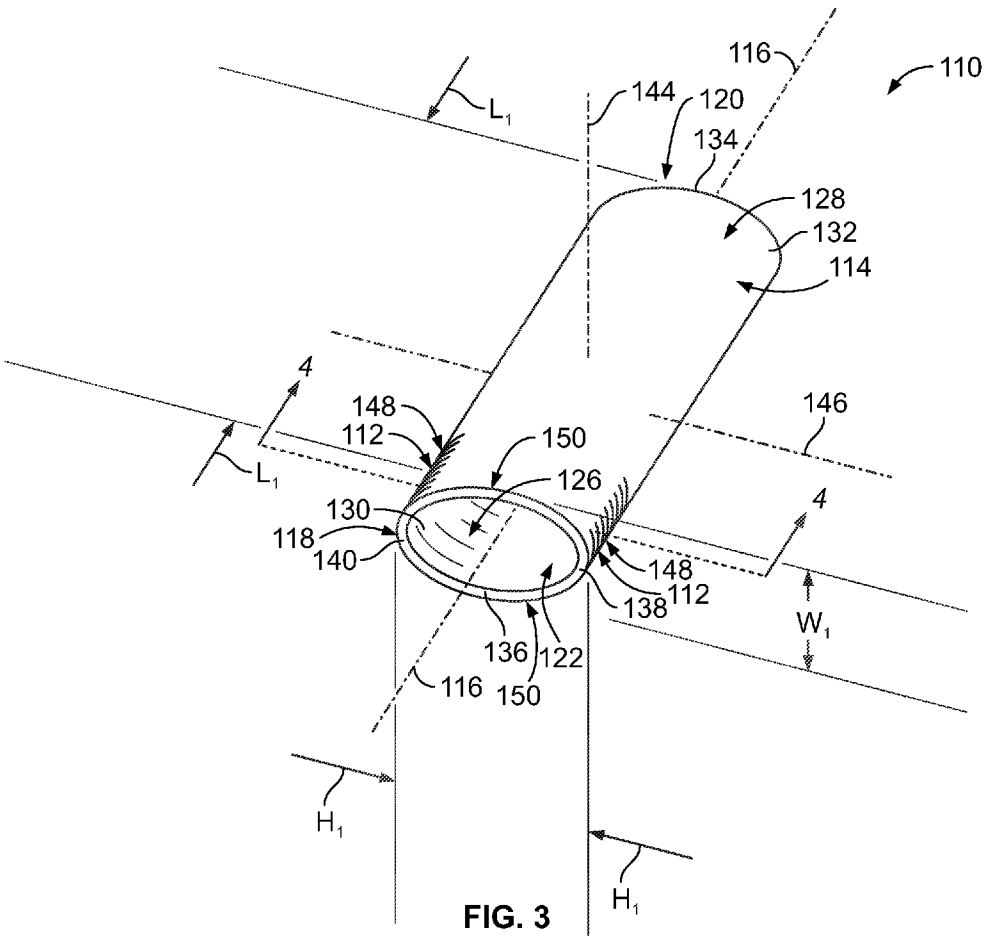
FIG. 3 is a perspective view of another exemplary embodiment of a connection member.

FIG. 3 is a perspective view of another exemplary embodiment of a connection member 110. The connection member 110 includes stamped threads 112 that enable the connection member 110 to be threadably connected to complementary threads (not shown) of a complementary connection member (not shown). In some embodiments, the connection member 110 is also an electrical contact. For example, the connection member 110 may be at least partially electrically conductive and engagement between the connection member 110 and the complementary connection member may establish an electrical connection therebetween. The connection member 110 may be referred to herein as an "electrical contact".

The connection member 110 includes a tube 114 that extends a length $L_1$ along a central longitudinal axis 116 from an end 118 to an opposite end 120. The tube 114 includes a central passageway 122 that extends along the central longitudinal axis 116 and through the length $L_1$ of the tube 114. The tube 114 includes an interior side 126 and an opposite exterior side 128. The sides 126 and 128 include respective interior and exterior surfaces 130 and 132.

Along the length $L_1$, the tube 114 has a non-circular cross-sectional shape taken along a plane that extends approximately perpendicular to the central longitudinal axis 116. In the exemplary embodiment, the tube 114 has an oval cross-sectional shape, along the length $L_1$ of the tube 114, that is taken along a plane that extends approximately perpendicular to the central longitudinal axis 116. But, the tube 114 may have any non-circular cross-sectional shape, along the length $L_1$, that is taken along a plane that extends approximately perpendicular to the central longitudinal axis 116.

Figure 4:
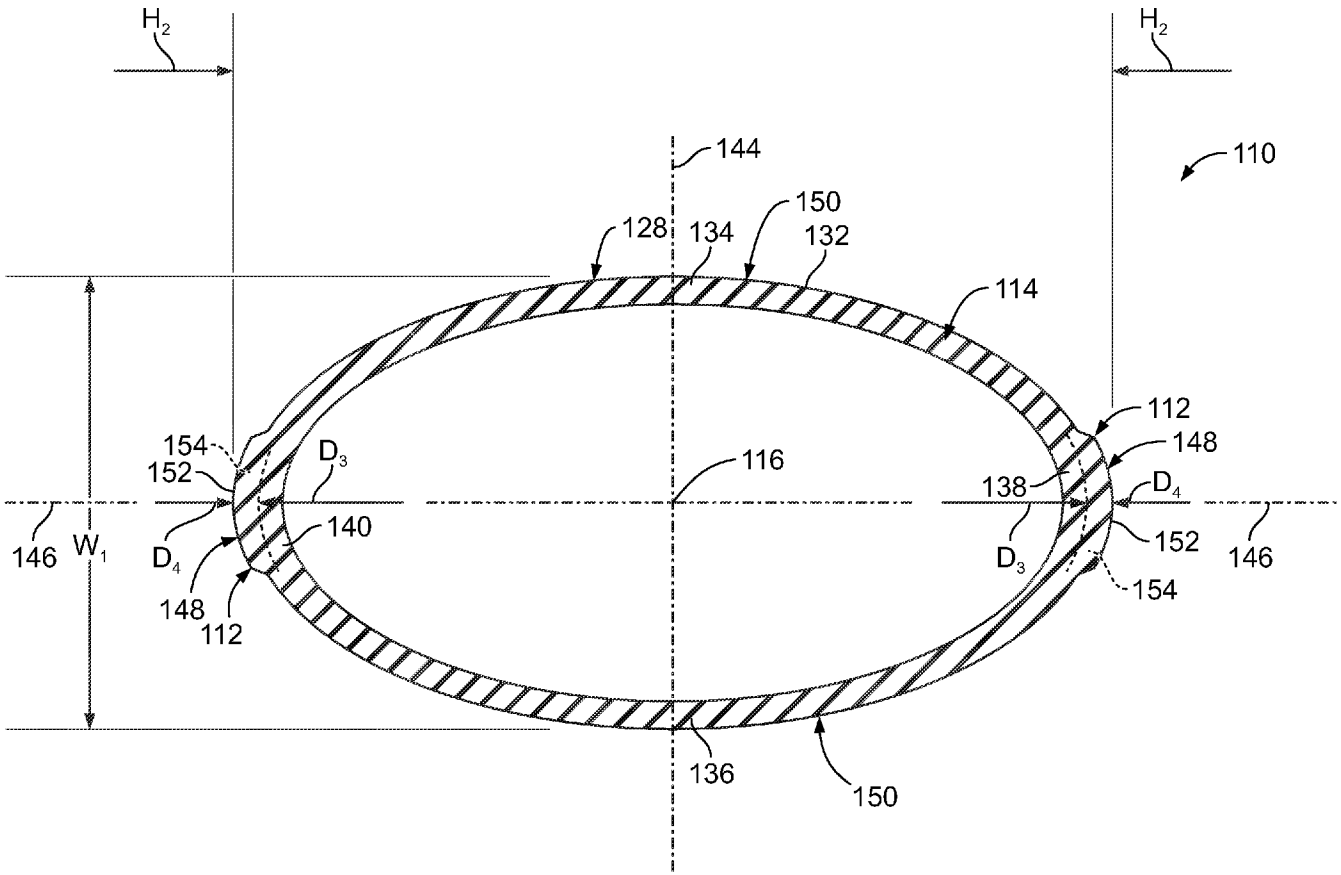
FIG. 4 is a cross-sectional view of the connection member shown in FIG. 3 taken along line 4-4 of FIG. 3.

FIG. 4 is a cross-sectional view of the connection member 110 taken along line 4-4 of FIG. 3. The cross section of FIG. 4 is taken along a plane that extends approximately perpendicular to the central longitudinal axis 116. Referring now to FIGS. 3 and 4, the oval cross-sectional shape of the tube 114 is defined by opposing greater-radius walls 134 and 136 and opposing lesser-radius walls 138 and 140 of the tube 14. The lesser-radius walls 138 and 140 intersect the greater-radius walls 134 and 136. The greater-radius walls 134 and 136 have a radius of curvature that is greater than the radius of curvature of the lesser-radius walls 138 and 140. The tube 114 may include any number of walls that define any non-circular cross-sectional shape.

The exterior surface 132 of the exterior side 128 of the tube 114 defines a perimeter of the non-circular cross-sectional shape of the tube 114. The tube 114 extends a width $W_1$ defined from the exterior surface 132 at the greater-radius wall 134 to the exterior surface 132 at the greater diameter wall 136. The tube 114 extends a height $H_1$ from the exterior surface 132 at the lesser-radius wall 138 to the exterior surface 132 at the lesser-radius wall 140. The tube 114 extends the width $W_1$ and the height $H_1$ along respective width and height axes 144 and 146. The axes 144 and 146 extend approximately perpendicular to the central longitudinal axis 116 and to each other.

The stamped threads 112 are referred to as "stamped threads" because the stamped threads 112 are formed using a stamping process, as will be described in more detail below. The stamped threads 112 are formed on the exterior side 128, and specifically into the exterior surface 132, of the tube 114 along at least a portion of the length $L_1$ of the tube 114. The stamped threads 112 may be formed at any location(s) along the length $L_1$ of the tube 114. In the exemplary embodiment, the stamped threads 112 are formed on the exterior side 128 at the end 118 of the tube 114 and along a portion of the length $L_1$ of the tube 114 that extends from the end 118. In addition or alternatively to being formed at the end 118, the stamped threads 112 may be formed on the exterior side 128 at the end 120 of the tube 114. In some alternative embodiments, the stamped threads 112 are formed on the exterior side 128 along an entirety of the length $L_1$ of the tube 114. Moreover, in some alternative embodiments, the stamped threads 112 are formed on the exterior side 128 along two or more distinct segments of the length $L_1$ of the tube 114.

The stamped threads 112 are discontinuous along the perimeter of the non-circular cross-sectional shape of the tube 114 such that the stamped threads 112 only extend along at least one portion of the perimeter of the non-circular cross-sectional shape of the tube 114. Along the perimeter of the cross-sectional shape of the tube 114, the stamped threads 112 are only formed on the exterior side 128 of the tube 114 at one or more partial segments of the perimeter. When the stamped threads 112 are formed on the exterior side 128 at more than one partial segment of the perimeter, the plurality of partial segments of the perimeter are spaced-apart from each other along the perimeter.

In the exemplary embodiment, the at least one portion of the perimeter along which the stamped threads 112 are formed includes the lesser-radius walls 138 and 140 of the tube 114. Specifically, the stamped threads 112 are formed on the exterior side 128 of the tube 114 at two partial segments 148 of the perimeter of the non-circular cross-sectional shape of the tube 114. The two partial segments 148 of the perimeter along which the stamped threads 112 are formed include the lesser-radius walls 138 and 140, such that the stamped threads 112 are formed on the exterior side 128 of the tube 114 along the lesser-radius walls 138 and 140. The two partial segments 148 of the perimeter along which the stamped threads 112 are formed are spaced-apart from each other along the perimeter. The greater-radius walls 134 and 136 include segments 150 that are aligned along the length $L_1$ of the tube 114 with the stamped threads 112 and are devoid of the stamped threads 112. In other words, the segments 150 do not include the stamped threads 112.

The stamped threads 112 may be formed along any number of the partial segments 148 of the perimeter. The stamped threads 112 are not limited to being formed on the exterior side 128 of the tube 114 along the lesser-radius walls 138 and 140, but rather may be additionally or alternatively formed at any other location(s) along the perimeter. In some alternative embodiments, the stamped threads 112 are formed along only one of the lesser-diameter walls 138 or 140.

Referring now solely to FIG. 4, the stamped threads 112 include peaks 152 and troughs 154. A minor diameter $D_3$ of the stamped threads 112 is defined at the troughs 154 of the stamped threads 112. A major diameter $D_4$ of the stamped threads 112 is defined at the peaks 152 of the stamped threads 112. The minor diameter $D_3$ of the stamped threads 112 is greater than the width $W_1$ of the tube 114. Similarly, the major diameter $D_4$ of the stamped threads 112 is greater than the width $W_1$ of the tube 114. The stamped threads 112 may be fine threads or coarse threads. The stamped threads 112 may have any size.

The peaks 152 of the stamped threads 112 may increase the outer dimension of the exterior surface 132 of the exterior side 128 of the tube 114 as the stamped threads 112 are formed into the exterior surface 132. In other words, forming of the stamped threads 112 on the exterior side 128 may cause a radially (relative to the central longitudinal axis 116) outward extrusion of portions of the exterior surface 132 that form the peaks 152.

The tube 114 may be fabricated from any material(s). In some embodiments, the tube 114 is fabricated from any material(s) that enable the tube 114 to be electrically conductive. The tube 114 may be fabricated using any method, process, structure, means, and/or the like, such as, but not limited to, using a cutting process, using a casting process, using a die-casting process, using a molding process, using a forming process, and/or the like. Cutting processes include, but are not limited to, water cutting, stamping, laser cutting, punching, cutting using a saw, drill bit, plane, mill, and/or other solid cutting tool, and/or the like. Forming processes include, but are not limited to, drawing, bending, and/or the like. When the tube 114 is fabricated using a cutting process, the tube 114 may be cut from a reel of material, from a blank of material, from an approximately flat sheet of material, from an approximately flat material, from a rod of material, from a length of tubing, and/or the like.

In some embodiments, the tube 114 is cut from a length of tubing that has the oval cross-sectional shape of the tube 114. In some other embodiments, the tube 114 is a cut and formed tube that is cut from a material and then formed to include the shape of the tube 14. An example of a cut and formed tube includes cutting a length of tubing that has a circular cross-sectional shape and then deforming the cut tube to give the tube 114 the oval cross-sectional shape. Another example of a cut and formed tube includes cutting a rectangular blank out of an approximately flat sheet of material. Once the material has been cut, the material may be formed to define the finished shape of the tube 114. For example, the rectangular blank may be bent to define the walls 134, 136, 138, and 140 and the oval cross-sectional shape of the tube 114. When cut and formed in such a manner, the finished shape of the tube 114 may include a seam (not shown). In some embodiments, the tube 114 is a stamped and formed tube that is stamped from a material and then formed to include the finished shape of the tube 114. Moreover, in some embodiments, the tube 114 is a cut and drawn tube that is cut from a material and drawn around a mandrel (not shown) to form the finished shape of the tube 114. Cut and formed connection members may be less expensive to fabricate than machined connection members.

Figure 6:
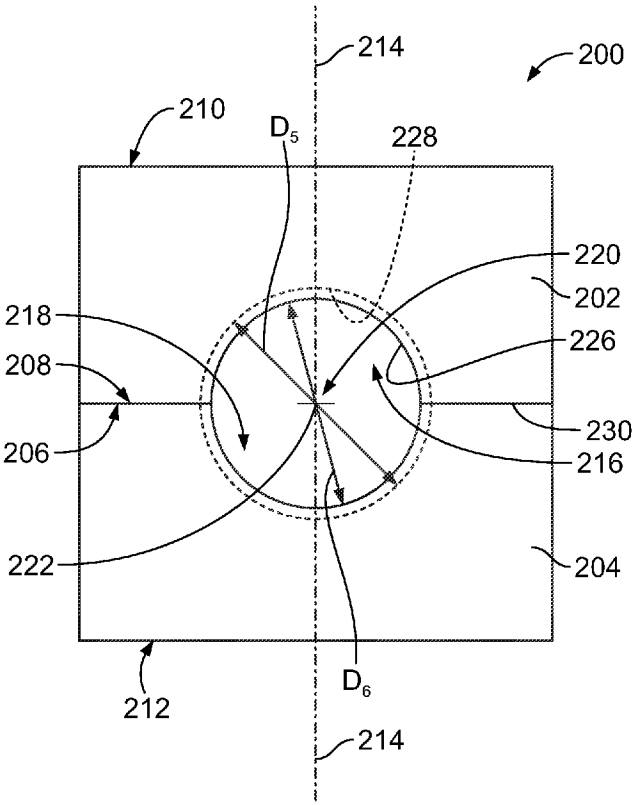
FIG. 6 is an elevational view of the die shown in FIG. 5.
Figure 5:
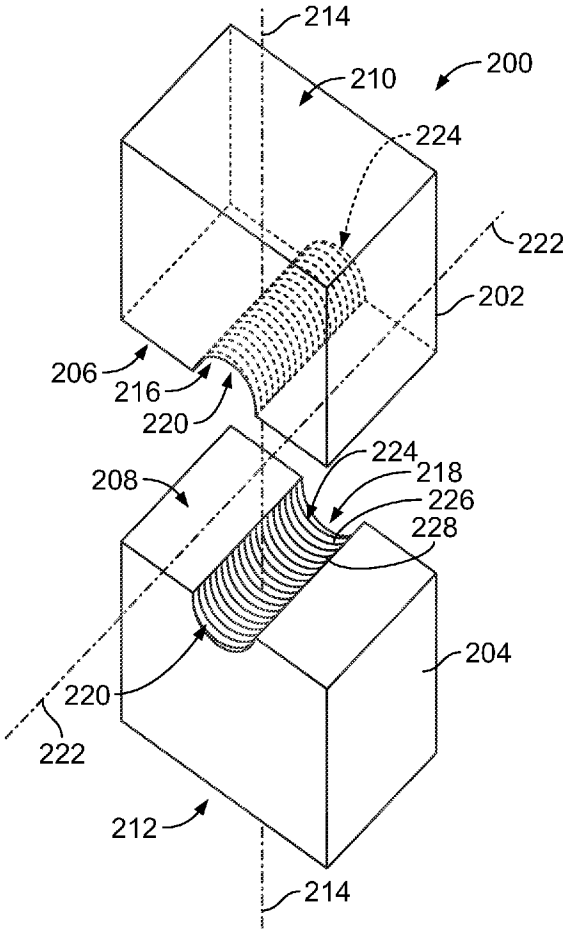
FIG. 5 is an exploded perspective view of an exemplary embodiment of a die that may be used to fabricate the connection members shown in FIGS. 1-4.

As described above, the stamped threads 12 (FIGS. 1, 2, 7, and 9) of the tube 14 (FIGS. 1, 2, 7, and 9) and the stamped threads 112 of the tube 114 are formed using a stamping process. FIG. 5 is an exploded perspective view of an exemplary embodiment of a die 200 that may be used to stamp the threads 12 and/or the threads 112. FIG. 6 is an elevational view of the die 200. Referring now to FIGS. 5 and 6, the die 200 includes opposing jaws 202 and 204. The jaws 202 and 204 include respective component sides 206 and 208 and respective tooling sides 210 and 212 that are opposite the components sides 206 and 208, respectively. As shown in FIGS. 5 and 6, the jaws 202 and 204 are aligned along a stamping axis 214 with the components sides 206 and 208 facing each other Each of the jaws 202 and 204 includes a recess 216 and 218, respectively, that extends into the component side 206 and 208, respectively. The recesses 216 and 218 cooperate to define a tube opening 220. Specifically, the recesses 216 and 218 cooperate with each other to define the tube opening 220 when the jaws 202 and 204 are arranged such that the jaws 202 and 204 are aligned along the stamping axis 214 with the component sides 206 and 208 facing each other. Although shown in FIG. 6 as being engaged, the component sides 206 and 208 may not be engaged with each other when the jaws 202 and 204 are arranged such that the recesses 216 and 218 cooperate to define the tube opening 220.

The tube opening 220 of the die 200 extends a length through the die 200 along a central longitudinal axis 222. The length of the tube opening 220 is configured to receive the length L (FIGS. 1, 2, and 9) of the tube 14 (FIGS. 1, 2, 7, and 9) and/or the length $L_1$ (FIGS. 3 and 4) of the tube 114 (FIGS. 3, 4, and 8) therein to stamp the respective stamped threads 12 and/or 112. As can be seen in FIGS. 5 and 6, the tube opening 220 has a circular cross-sectional shape taken along a plane that extends approximately perpendicular to the central longitudinal axis 222. Because the tube opening 220 has a circular cross-sectional shape, the die may be referred to herein as a "circular die".

The recesses 216 and 218 of the jaws 202 and 204, respectively, include forming threads 224. The forming threads 224 are sized and shaped complementary with the stamped threads 12 and/or the stamped threads 112. The forming threads 224 are configured to form the stamped threads 12 and/or 112 into the respective tube 14 and/or 114 by a stamping process. The forming threads 224 include peaks 226 and troughs 228. A major diameter $D_5$ of the forming threads 224 is defined at the troughs 228, while a minor diameter $D_6$ of the forming threads 224 is defined at the peaks 226 of the forming threads 112.

Figure 7:
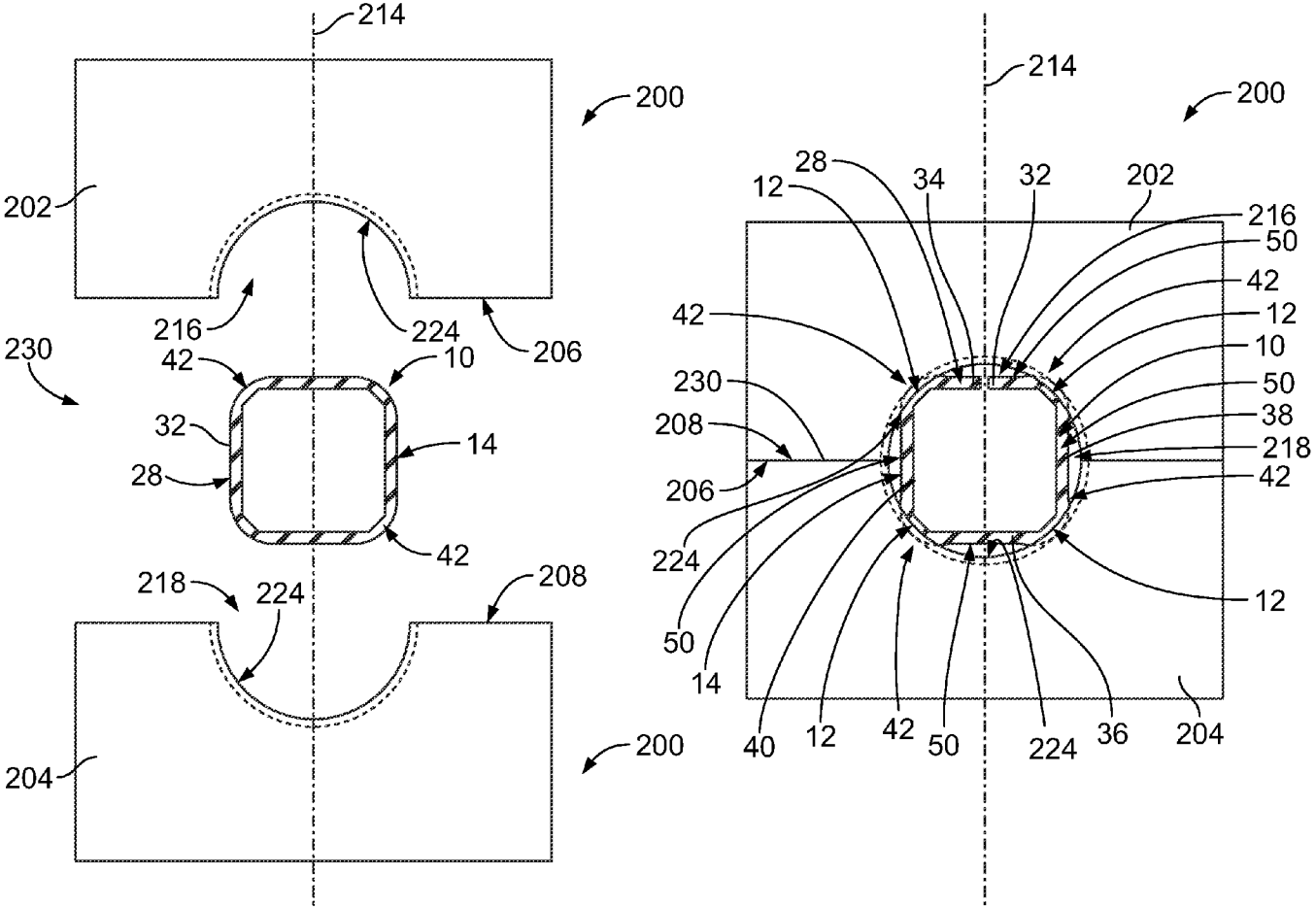
FIG. 7 is an elevational view illustrating an exemplary embodiment of a stamping process for forming stamped threads on the connection member shown in FIGS. 1 and 2 using the die shown in FIGS. 5 and 6.

FIG. 7 is an elevational view illustrating an exemplary embodiment of a stamping process for forming the stamped threads 12 on the tube 14 of the connection member 10 using the die 200. The jaws 202 and 204 of the die 200 are aligned along the stamping axis 214 with the components sides 206 and 208 facing each other. The tube 14 is positioned between the jaws 202 and 204 such that the tube 14 is aligned with the recesses 216 and 218. The tube 14 is optionally positioned within the recess 216 and/or the recess 218 before forming the stamped threads 12. For example, the tube 14 may rest on the jaw 202 or 204 within the respective recess 216 or 218 before the stamped threads 12 are formed.

The jaws 202 and 204 are moved relative to, and toward, each other along the stamping axis 214 into engagement with the tube 14. As the forming threads 224 of the jaws 202 and 204 are forced against the exterior side 28 of the tube 14, the forming threads 224 form the stamped threads 12 within the exterior surface 32 of the exterior side 28. In the exemplary embodiment, the circular cross-sectional shape of the die 200 forms the stamped threads 12 along the corners 42 of the rectangular cross-sectional shape of the tube 14. Moreover, the circular cross-sectional shape of the die 200 forms the stamped threads 12 on the tube 14 such that the segments 50 of the walls 34, 36, 38, and 40 of the tube 14 are devoid of the stamped threads 12. As should be apparent from FIGS. 1, 2, 6, and 7, the major diameter $D_5$ (FIG. 6) and the minor diameter $D_6$ (FIG. 6) of the forming threads 224 are each greater than the width W (FIGS. 1 and 2) of the tube 14. Moreover, the major diameter $D_5$ and the minor diameter $D_6$ of the forming threads 224 are each greater than the height H (FIGS. 1 and 2) of the tube 14.

A seam 230 is defined between the component sides 206 and 208 of the jaws 202 and 204, respectively, during the stamping process. The difference between the cross-sectional shapes of the die 200 and the tube 14 may prevent or reduce flashing of the material of the tube 14 into the seam 230.

In the exemplary embodiment, the component sides 206 and 208 of the jaws 202 and 204, respectively, engage each other during the stamping process, as is shown in FIG. 7. Alternatively, the component sides 206 and 208 of the respective jaws 202 and 204 do not engage each other during the stamping process. The seam 230 is defined between the jaws 202 and 204 whether or not the components surfaces 206 and 208 engage each other during the stamping process. As described above, the jaws 202 and 204 move relative to each other during the stamping process. The jaws 202 and 204 may both move relative to a stationary reference during the stamping process. Alternatively, one of the jaws 202 or 204 remains stationary relative to the stationary reference and the other jaw 202 or 204 moves relative to the stationary reference during the stamping process.

Figure 8:
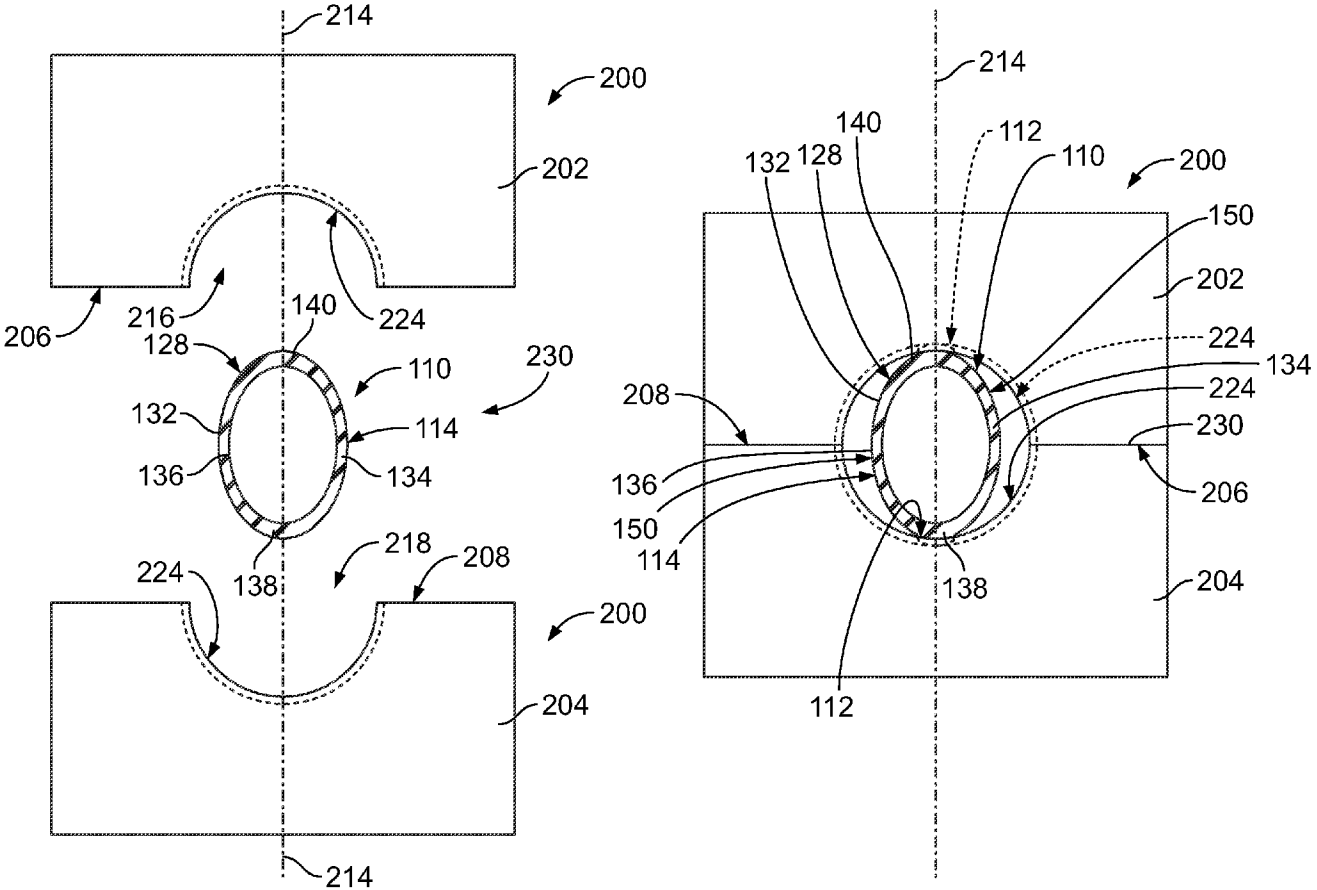
FIG. 8 is an elevational view illustrating an exemplary embodiment of a stamping process for forming stamped threads on the connection member shown in FIGS. 3 and 4 using the die shown in FIGS. 5 and 6.

FIG. 8 is an elevational view illustrating an exemplary embodiment of a stamping process for forming the stamped threads 112 on the tube 114 of the connection member 110 using the die 200. The jaws 202 and 204 of the die 200 are aligned along the stamping axis 214 with the components sides 206 and 208 facing each other. The tube 114 is positioned between the jaws 202 and 204 such that the tube 114 is aligned with the recesses 216 and 218. The tube 14 is optionally positioned within the recess 216 and/or the recess 218 before forming the stamped threads 112. For example, the tube 114 may rest on the jaw 202 or 204 within the respective recess 216 or 218 before the stamped threads 112 are formed.

The jaws 202 and 204 are moved relative to, and toward, each other along the stamping axis 214 into engagement with the tube 114. As the forming threads 224 of the jaws 202 and 204 are forced against the exterior side 128 of the tube 114, the forming threads 224 form the stamped threads 112 within the exterior surface 132 of the exterior side 128. In the exemplary embodiment, the circular cross-sectional shape of the die 200 forms the stamped threads 112 along the lesser-radius walls 138 and 140 of oval cross-sectional shape of the tube 114. Moreover, the circular cross-sectional shape of the die 200 forms the stamped threads 112 on the tube 114 such that the segments 150 of the greater-radius walls 134 and 136 of the tube 114 are devoid of the stamped threads 112. As should be apparent from FIGS. 3, 4, 6, and 8, the major diameter $D_5$ (FIG. 6) and the minor diameter $D_6$ (FIG. 6) of the forming threads 224 are each greater than the width $W_1$ (FIGS. 3 and 4) of the tube 114.

The seam 230 is defined between the component sides 206 and 208 of the jaws 202 and 204, respectively, during the stamping process. The difference between the cross-sectional shapes of the die 200 and the tube 114 may prevent or reduce flashing of the material of the tube 114 into the seam 230.

In the exemplary embodiment, the component sides 206 and 208 of the jaws 202 and 204, respectively, engage each other during the stamping process, as is shown in FIG. 8. Alternatively, the component sides 206 and 208 of the respective jaws 202 and 204 do not engage each other during the stamping process. The seam 230 is defined between the jaws 202 and 204 whether or not the components surfaces 206 and 208 engage each other during the stamping process. As described above, the jaws 202 and 204 move relative to each other during the stamping process. The jaws 202 and 204 may both move relative to a stationary reference during the stamping process. Alternatively, one of the jaws 202 or 204 remains stationary relative to the stationary reference and the other jaw 202 or 204 moves relative to the stationary reference during the stamping process.

Figure 9:
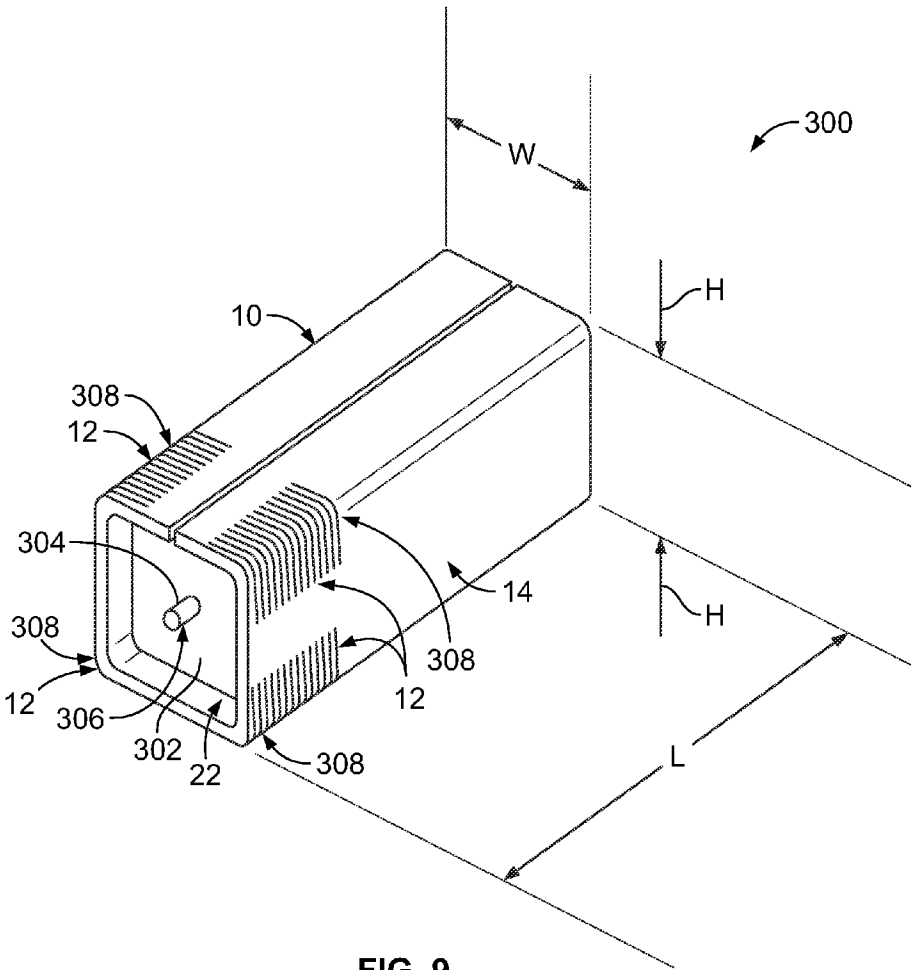
FIG. 9 is a perspective view of an exemplary embodiment of an electrical connector that includes the connection member shown in FIGS. 1 and 2.

FIG. 9 is a perspective view of an exemplary embodiment of an electrical connector 300 that includes the connection member 10. The connection member 10 includes the stamped threads 12 for threadably connecting the electrical connector 300 to a mating connector (not shown) having a connection member (not shown) that includes threads that are complementary with the stamped threads 12.

In the exemplary embodiment, the connection member 10 defines a housing of the electrical connector 300. Alternatively, the connection member 10 is not a housing of the electrical connector 300, but rather the electrical connector 300 includes a housing (not shown) that holds the connection member 10. A dielectric insert 302 is held within the central passageway 22 of the tube 14 of the connection member 10. An electrical contact 304 is held by the dielectric insert 302, and thus by the connection member 10. The electrical contact 304 includes a mating interface 306 at which the electrical contact 304 mates with a corresponding mating contact (not shown) of the mating connector. Although shown as being a pin, the electrical contact 304 may be any other type of electrical contact, such as, but not limited to, a receptacle contact and/or the like.

In the exemplary embodiment, the electrical connector 300 is a coaxial connector wherein the electrical contact 304 defines an inner electrical contact of the electrical connector 300. But, the electrical connector 300 may alternatively be any other type of electrical connector. In the exemplary embodiment, the tube 14 of the connection member 10 is electrically conductive and the connection member 10 defines an electrical contact of the electrical connector 300. Alternatively, the connection member 10 does not define an electrical contact of the electrical connector 300.

In the exemplary embodiment, the tube 14 defines an outer electrical contact of the electrical connector 300 that is configured to mate with a corresponding mating contact (not shown) of the mating connector. The tube 14 may mate with the corresponding mating contact at any location along the length L, width W, and/or height H of the tube 14. In the exemplary embodiment, the tube 14 mates with the corresponding mating contact at the end face of the end 18 of the tube 14. In addition or alternatively, the stamped threads 12 may define a mating interface 308 at which the tube 14 mates with the corresponding mating contact of the mating connector.

Although not shown herein, it should be understood that the connection member 110 (FIGS. 3, 4, and 8) may be a component of an electrical connector in a substantially similar manner to that shown and/or described herein with respect to the connection member 10 and the electrical connector 300.

The embodiments described and/or illustrated herein may provide a threaded connection member that is less costly to fabricate than at least some known connection members. The embodiments described and/or illustrated herein may provide a connection member that is less likely to experience flashing of the material of the connection member into a die seam during formation of stamped threads of the connection member using a stamping process.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connection member comprising:

a tube extending a length along a central longitudinal axis, the tube comprising a central passageway that extends through the length of the tube, the tube having a non-circular cross-sectional shape along the length of the tube, the tube including an exterior side that defines a perimeter of the non-circular cross-sectional shape of the tube; and stamped threads formed on the exterior side of the tube along at least a portion of the length of the tube, wherein the stamped threads are discontinuous along the perimeter of the non-circular cross-sectional shape of the tube such that the stamped threads only extend along at least one portion of the perimeter of the non-circular cross-sectional shape of the tube.

2. The connection member of claim 1, wherein the tube extends a width and a height along respective width and height axes that extend approximately perpendicular to the central longitudinal axis and each other, the stamped threads having a minor diameter that is greater than at least one of the width and the height of the tube.

3. The connection member of claim 1, wherein the tube includes a seam that extends along at least a portion of the length of the tube.

4. The connection member of claim 1, wherein the tube has at least one of a rectangular, an oval, or a square cross-sectional shape along the length of the tube.

5. The connection member of claim 1, wherein the tube has a rectangular cross-sectional shape defined by an upper wall, a lower wall, and opposing side walls, the upper wall, lower wall, and side walls comprising segments that are aligned along the central longitudinal axis with the stamped threads and are devoid of the stamped threads.

6. The connection member of claim 1, wherein the tube has a rectangular cross-sectional shape defined by an upper wall, a lower wall, and opposing side walls, the upper wall, the lower wall, and the side walls comprising flats that extend along the perimeter of the rectangular cross-sectional shape between adjacent segments of the stamped threads.

7. The connection member of claim 1, wherein the tube has an oval cross-sectional shape defined by opposing greater-radius walls and opposing lesser-radius walls that intersect the greater-radius walls, the greater-radius walls comprising segments that are aligned along the central longitudinal axis with the stamped threads and are devoid of the stamped threads.

8. The connection member of claim 1, wherein the tube has a rectangular cross-sectional shape defined by an upper wall, a lower wall, and side walls that intersect the upper and lower walls at corners, the stamped threads being formed on the exterior side along the corners such that the at least one portion of the perimeter comprises the corners.

9. The connection member of claim 1, wherein the tube has an oval cross-sectional shape defined by opposing greater-radius walls and opposing lesser-radius walls that intersect the greater-radius walls, the stamped threads being formed on the exterior side along the lesser-radius walls such that the at least one portion of the perimeter comprises the lesser diameter walls.

10. The connection member of claim 1, wherein the tube is a cut and formed tube.

11. The connection member of claim 1, wherein the tube is an electrical contact that is configured to mate with a mating contact, the tube comprising a mating interface at which the tube engages the mating contact.

12. The connection member of claim 1, wherein the tube extends a width and a height along respective width and height axes that extend approximately perpendicular to the central longitudinal axis and each other, the stamped threads being formed by a circular die having a diameter that is greater than at least one of the width and the height of the tube.

13. The connection member of claim 1, wherein the tube extends the length from an end to an opposite end, the stamped threads extending on the exterior side of the tube at least one of the ends.

14. An electrical connector for mating with a mating connector, the electrical connector comprising:

an electrical contact having a mating interface, the electrical contact being configured to mate with a mating contact of the mating connector at the mating interface; and a housing holding the electrical contact, the housing comprising a connection member that is configured to be threadably connected to the mating connector, the connection member comprising a tube extending a length along a central longitudinal axis, the tube comprising a central passageway that extends through the length of the tube, the tube having a non-circular cross-sectional shape along the length of the tube, the tube including an exterior side that defines a perimeter of the non-circular cross-sectional shape of the tube, wherein stamped threads are formed on the exterior side of the tube along at least a portion of the length of the tube, the stamped threads being discontinuous along the perimeter of the non-circular cross-sectional shape of the tube such that the stamped threads only extend along at least one portion of the perimeter of the non-circular cross-sectional shape of the tube.

15. The electrical connector of claim 14, wherein the tube extends a width and a height along respective width and height axes that extend approximately perpendicular to the central longitudinal axis and each other, the stamped threads having a minor diameter that is greater than at least one of the width and the height of the tube.

16. The electrical connector of claim 14, wherein the tube has a rectangular cross-sectional shape defined by an upper wall, a lower wall, and side walls that intersect the upper and lower walls at corners, the stamped threads being formed on the exterior side along the corners such that the at least one portion of the perimeter comprises the corners.

17. The electrical connector of claim 14, wherein the tube has an oval cross-sectional shape defined by opposing greater-radius walls and opposing lesser-radius walls that intersect the greater-radius walls, the stamped threads being formed on the exterior side along the lesser-radius walls such that the at least one portion of the perimeter comprises the lesser diameter walls.

18. A connection member comprising:

a tube extending a length along a central longitudinal axis, the tube extending a width and a height along respective width and height axes that extend approximately perpendicular to the central longitudinal axis and each other, the tube including an exterior side; and stamped threads formed on the exterior side of the tube along at least a portion of the length of the tube, wherein the stamped threads have a minor diameter that is greater than at least one of the width and the height of the tube.

19. The connection member of claim 18, wherein the stamped threads are formed on the exterior side using a circular die.

20. The connection member of claim 18, wherein the stamped threads are formed by a die having a diameter that is greater than at least one of the width and the height of the tube.

* * * * *